US011323834B1

(12) United States Patent
Wang et al.

(10) Patent No.: US 11,323,834 B1
(45) Date of Patent: May 3, 2022

(54) HEARING DEVICE HAVING A SHELL INCLUDING REGIONS WITH DIFFERENT MODULI OF ELASTICITY AND METHODS OF MANUFACTURING THE SAME

(71) Applicant: SONOVA AG, Staefa (CH)

(72) Inventors: Frank Wang, San Bruno, CA (US); Michael Au, Union City, CA (US)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/200,320

(22) Filed: Mar. 12, 2021

(51) Int. Cl.
*H04R 25/00* (2006.01)
*H04R 25/02* (2006.01)

(52) U.S. Cl.
CPC ..... *H04R 25/658* (2013.01); *H04R 25/02* (2013.01); *H04R 25/652* (2013.01); *H04R 2225/023* (2013.01)

(58) Field of Classification Search
CPC .... H04R 25/658; H04R 25/02; H04R 25/652; H04R 2225/023
See application file for complete search history.

(56) References Cited

U.S. PATENT DOCUMENTS

| | | | | |
|---|---|---|---|---|
| 6,393,130 | B1 | 5/2002 | Stonikas | |
| 2019/0253783 | A1* | 8/2019 | O'Callaghan | H04R 1/345 |
| 2021/0017302 | A1* | 1/2021 | Cheng | C08F 220/34 |

FOREIGN PATENT DOCUMENTS

| | | |
|---|---|---|
| CA | 2314890 | 6/1999 |
| DE | 202004001165 | 6/2004 |
| WO | 1999056501 | 11/1999 |
| WO | 2000047016 | 8/2000 |
| WO | 2010096032 | 8/2010 |
| WO | 2018099562 | 6/2018 |

* cited by examiner

*Primary Examiner* — Andrew L Sniezek
(74) *Attorney, Agent, or Firm* — ALG Intellectual Property, LLC

(57) ABSTRACT

An exemplary hearing device configured to facilitate hearing by a user may comprise an in-the-ear ("ITE") component comprising a shell having a contoured outer surface configured to fit at least partially within an ear canal of the user. The contoured outer surface of the shell may include a first region having a first modulus of elasticity and a second region having a second modulus of elasticity that is different than the first modulus of elasticity. The first region and the second region may be formed of a same material.

17 Claims, 10 Drawing Sheets

HEARING DEVICE HAVING A SHELL INCLUDING REGIONS WITH DIFFERENT MODULI OF ELASTICITY AND METHODS OF MANUFACTURING THE SAME

BACKGROUND INFORMATION

Hearing devices (e.g., hearing aids) are used to improve the hearing capability and/or communication capability of users of the hearing devices. Such hearing devices are configured to process a received input sound signal (e.g., ambient sound) and provide the processed input sound signal to the user (e.g., by way of a receiver (e.g., a speaker) placed in the user's ear canal or at any other suitable location). In addition, such hearing devices are typically customized for a user based on various factors associated with the user such as the user's particular hearing loss characteristics, the desired components of the customized hearing device, aesthetic preferences of the user, and/or the amount of ear space (e.g., within an ear canal of the user) available to receive the customized hearing device.

A customized hearing device typically includes a shell that houses various components of the hearing device and that is configured to fit at least partially within the ear canal of a user. A shell for a hearing device is typically made of a single type of rigid material such as acrylic or titanium that have uniform mechanical properties. A customized shell may improve placement and/or retention of the hearing device in the ear canal as compared to non-customized shells due to increased surface area contact of the customized shell with respect to a wall of the ear canal. However, even with such improved placement and/or retention, a customized shell made of acrylic or titanium is still susceptible to acoustic feedback due to being uniformly rigid and poor retention and/or migration due to changes that may occur in ear canal shape during use of the hearing device. For example, jaw movements (e.g., due to chewing or talking) may increase space within the ear canal and negatively affect retention of the hearing device within the ear canal. In addition, such jaw movements may decrease space in certain areas of the ear canal and push the wall of the ear canal against the shell. This may increase pressure felt by the user in those areas, resulting in discomfort to the user and/or reduced wearability of the hearing device.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

FIGS. 5-7B illustrate additional exemplary configurations of an ITE component that may be implemented according to principles described herein.

DETAILED DESCRIPTION

Hearing devices having a shell including regions with different moduli of elasticity and methods of manufacturing the same are described herein. Such hearing devices may be configured to facilitate hearing by a user. As will be described in more detail below, an exemplary hearing device may comprise an ITE component comprising a shell having a contoured outer surface configured to fit at least partially within an ear canal of the user. The contoured outer surface of the shell may include a first region having a first modulus of elasticity and a second region having a second modulus of elasticity that is different than the first modulus of elasticity. The first region and the second region of the contoured outer surface of the shell may be formed of a same material.

By providing hearing devices such as those described herein, it may be possible to improve retention of an ITE component within an ear canal of a user even when the geometry of the ear canal changes (e.g., due to jaw movements) during use of the hearing device. In addition, because hearing devices such as those described herein include shells having regions with different moduli of elasticity, it may be possible to maintain tactile push-ability of the ITE component while increasing comfort and wearability of the ITE component as compared to conventional ITE components. Moreover, hearing devices such as those described herein that include shells having regions with different moduli of elasticity may have improved acoustic performance because they may be less likely to have an acoustic feedback problem while the hearing device is worn by a user (e.g., during mastication). Other benefits of the hearing devices and methods described herein will be made apparent herein.

As will be described further herein, hearing devices manufactured according to principles described herein include a shell that is formed of a single material but that includes two or more regions that have different moduli of elasticity. As used herein, a "hearing device" may be implemented by any device or combination of devices configured to provide or enhance hearing to a user.

Figure 1:
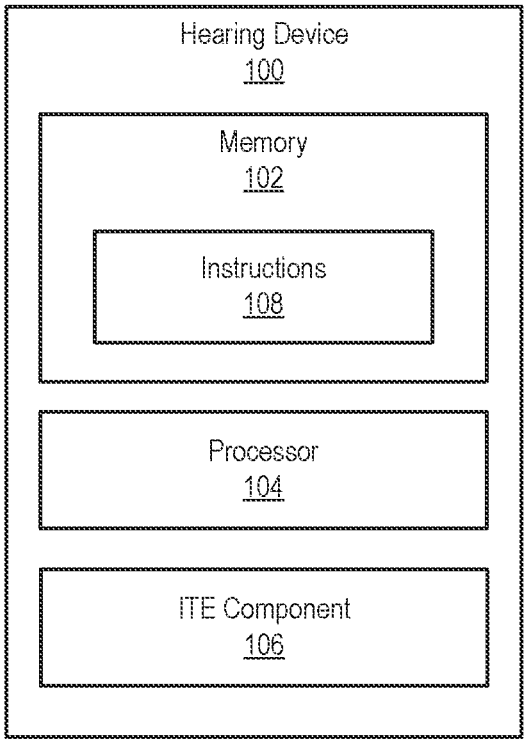
FIG. 1 illustrates an exemplary hearing device according to principles described herein.

FIG. 1 illustrates an exemplary hearing device 100 that is configured to assist a user in hearing. As shown, hearing device 100 may include, without limitation, a memory 102, a processor 104, and an ITE component 106 selectively and communicatively coupled to one another. Memory 102 and processor 104 may each include or be implemented by hardware and/or software components (e.g., processors, memories, communication interfaces, instructions stored in memory for execution by the processors, etc.). In some examples, memory 102 and processor 104 may be housed within or form part of ITE component 106. In some examples, memory 102 and processor 104 may be located separately from ITE component 106 (e.g., in a behind-the-ear ("BTE") component). In some alternative examples, memory 102 and processor 104 may be distributed between multiple devices (e.g., multiple hearing devices in a binaural hearing system) and/or multiple locations as may serve a particular implementation.

Memory 102 may maintain (e.g., store) executable data used by processor 104 to perform any of the operations associated with hearing device 100. For example, memory 102 may store instructions 108 that may be executed by processor 104 to perform any of the operations associated with hearing device 100 assisting a user in hearing. Instructions 108 may be implemented by any suitable application, software, code, and/or other executable data instance.

Memory 102 may also maintain any data received, generated, managed, used, and/or transmitted by processor 104. For example, memory 102 may maintain any suitable data associated with a hearing loss profile of a user, fitting parameters used to fit hearing device 100 to the user, etc. Memory 102 may maintain additional or alternative data in other implementations.

Processor 104 is configured to perform any suitable processing operation that may be associated with hearing device 100. For example, when hearing device 100 is implemented by a hearing aid device, such processing operations may include monitoring ambient sound and/or representing sound to a user via an in-ear receiver. Processor 104 may be implemented by any suitable combination of hardware and software.

Figure 2:
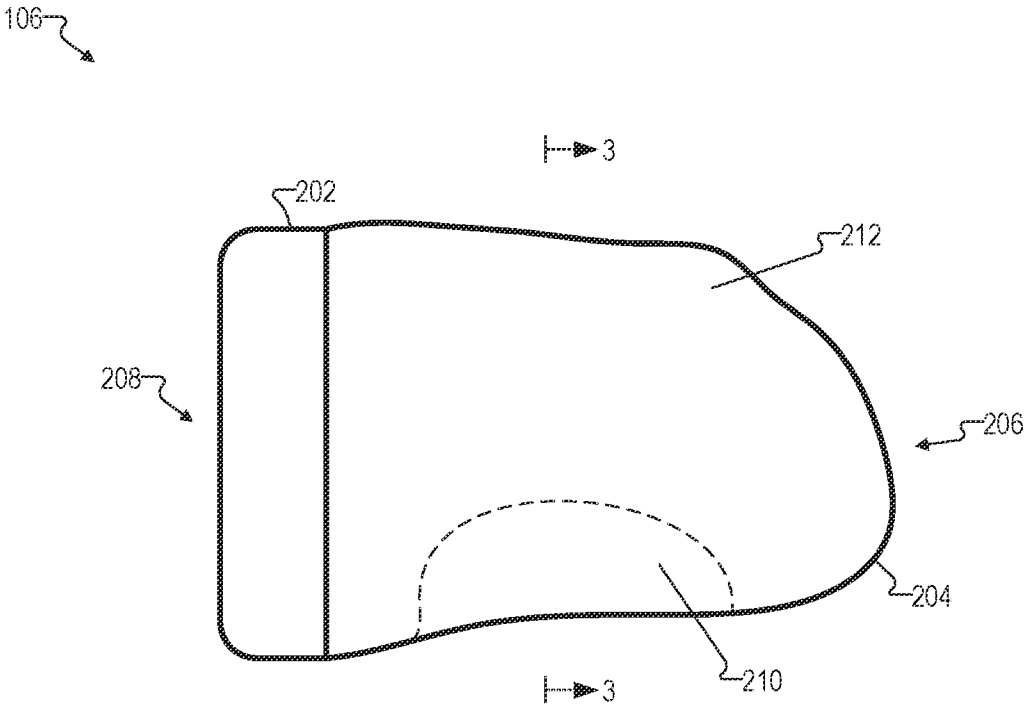
FIG. 2 illustrates exemplary in-the-ear ("ITE") component of a hearing device according to principles described herein.

FIG. 2 shows an exemplary configuration of ITE component 106. As shown in FIG. 2, ITE component 106 may include a faceplate 202, a shell 204, a medial end 206 that faces into the ear canal when ITE component 106 is worn by the user, and a lateral end 208 that faces out of the ear canal when ITE component 106 is worn by the user. Faceplate 202 is configured to fit within an opening of shell 204 that opens to the left to receive faceplate 202 and close shell 204 at a side oriented towards the exterior of the user's ear.

As shown in FIG. 2, shell 204 has a contoured outer surface that is configured to fit at least partially within an ear canal of the user and that may be formed in any suitable manner such as described herein. The contoured outer surface of shell 204 of ITE component 106 may include any suitable number of regions with any suitable number of different moduli of elasticity as may serve a particular implementation. In the example shown in FIG. 2, the contoured outer surface of shell 204 includes a first region 210 having a first modulus of elasticity and a second region 212 having a second modulus of elasticity that is different than the second modulus of elasticity. In the example shown in FIG. 2, first region 210 is located on a lower portion of shell 204 and is defined by a dashed line boundary. Second region 212 in the example shown in FIG. 2 may correspond to an entire remainder of the contoured outer surface of shell 204 that is not part of first region 210.

In the example shown in FIG. 2, the first modulus of elasticity of first region 210 may be less than the second modulus of elasticity of second region 212. The first modulus of elasticity may be any suitable amount less than the second modulus of elasticity as may serve a particular implementation. For example, the first modulus of elasticity may result in first region 210 having a softness of approximately Shore A 40 on the Durometer Shore A Hardness Scale. In contrast, the second modulus of elasticity may result in second region 212 having a softness of approximately Shore A 70. As such, first region 210 may be considered as a relatively more soft region of shell 204 whereas second region 212 may be considered as a relatively more hard region of shell 204. With such a configuration, it may be possible to mitigate acoustic feedback that may otherwise occur if shell 204 were formed entirely of a uniformly rigid material (e.g., titanium).

In the example shown in FIG. 2, the boundary between first region 210 and second region 212 that is indicated by the dashed line is provided for illustrative purposes. It is understood that in certain implementations shell 204 may or may not include a visible boundary between first region 210 and second region 212.

Shell 204 may be formed of any suitable material that that may be processed such that the same material may be used to form different regions of the shell that have different moduli of elasticity. For example, shell 204 of ITE component 106 may be formed of a resin such as a photopolymerization resin in certain examples.

Figure 3:
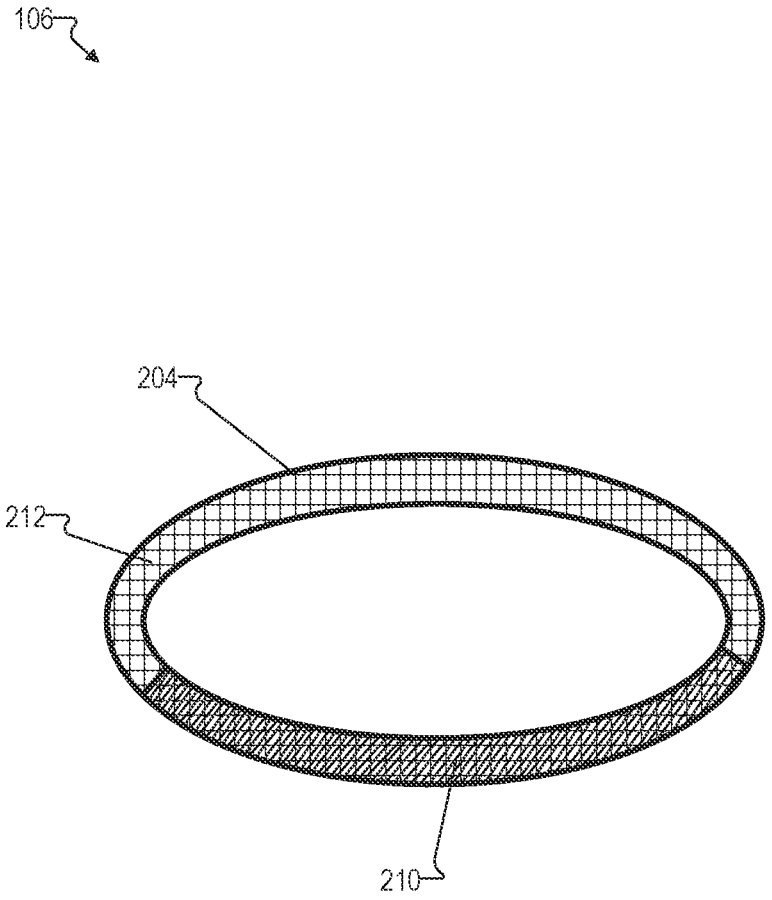
FIG. 3 illustrates an exemplary cross section of the ITE component shown in FIG. 2 that is taken along lines 3-3 in FIG. 2 according to principles described herein.

In certain examples, first region 210 of the contoured outer surface of shell 204 and second region 212 of the contoured outer surface of shell 204 may each have a same cross-sectional wall thickness. To illustrate, FIG. 3 shows a cross-section of shell 204 shown in FIG. 2 that is taken along lines 3-3 in FIG. 2. As shown in FIG. 3, first region 210 has a same cross-sectional wall thickness as second region 212. It is understood that the material in first region 210 may have the first modulus of elasticity from the contoured outer surface of shell 204 shown in FIG. 3 to an inner surface of shell 204. Similarly, the material in second region 212 may have the second modulus of elasticity from the contoured outer surface of shell 204 shown in FIG. 3 to the inner surface of shell 204. Such a configuration illustrates that the different moduli of elasticity of first region 210 and second region 212 may result from specific processing performed during manufacture of shell 204 as opposed to, for example, first region 210 merely having a cross-sectional thickness that is less than second region 212.

In FIG. 3, the cross-sectional thickness of shell 204 is exaggerated for illustrative purposes. It is understood that the cross-sectional thickness of shell 204 may be relatively much less than shown in FIG. 3 with respect to the shape of shell 204. For example, shell 204 may have a cross-sectional thickness on the order of a few millimeters. In addition, for simplicity, FIG. 3 shows the interior space within shell 204 as being empty. However, it is understood that the interior space may include any suitable circuitry, electronics, and/or other structures in certain implementations.

The various regions on the contoured outer surface of shell 204 may have any suitable shape and/or size as may serve a particular implementation. For example, in certain implementations, first region 210 of the contoured outer surface may have a size and/or shape that corresponds to a size and/or shape of a portion of an ear canal that changes shape and that is in contact with ITE component 106 during use of hearing device 100.

Figure 4:
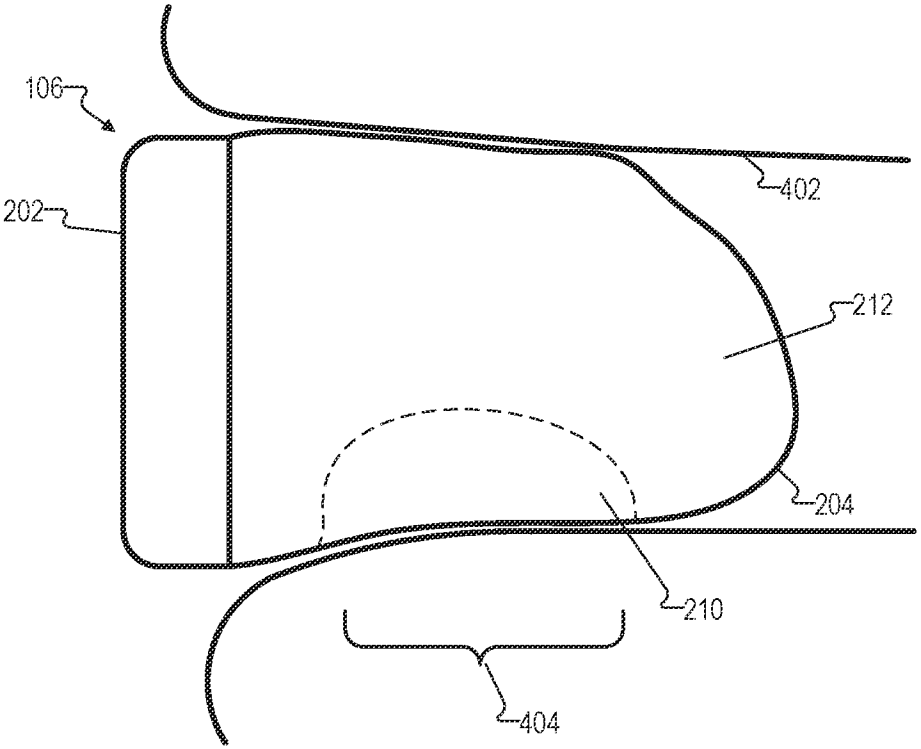
FIG. 4 illustrates an exemplary implementation in which the ITE component shown in FIG. 2 is inserted at least partially within an ear canal of a user according to principles described herein.

To illustrate, FIG. 4 shows how ITE component 106 may fit within an ear canal 402 of a user. As shown in FIG. 4, first region 210 may be located on shell 204 such that, when ITE component 106 is worn by the user, first region 210 lines up with and is approximately the same shape as a region 404 of ear canal 402 that changes shape with jaw movements of the user. In addition, first region 210 may be approximately the same size or slightly larger than region 404. When the user opens or closes their jaw, region 404 may press against first region 210 of shell 204 or may pull away from first region 210. Because first region 210 is relatively more soft or flexible than second region 212, first region 210 is configured to reduce pressure that may be felt in in region 404 when the ear canal that changes shape. As such, first region 210 is able to absorb fluctuations in the shape of ear canal 402 due to the jaw movements and improve wearability and comfortability of ITE component 106.

Figure 5:
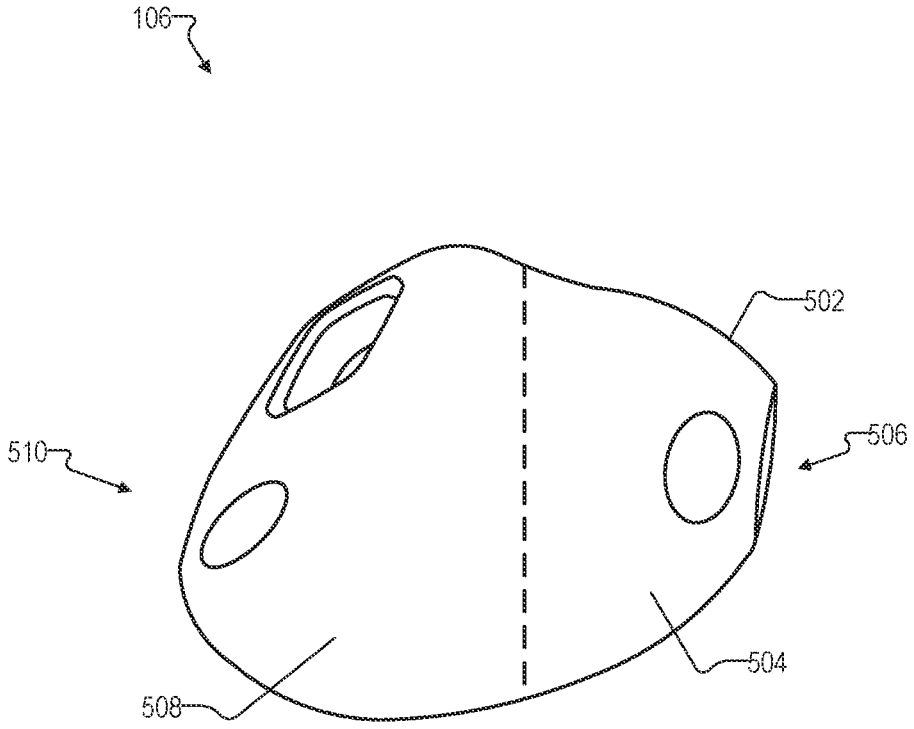

FIG. 5 shows another exemplary configuration of ITE component 106. In the example shown in FIG. 5, ITE component 106 includes a shell 502 having a contoured outer surface that may be formed in any suitable manner such as described herein. The contoured outer surface of shell 502 includes a first region 504 that has a first modulus of elasticity and is provided on a medial end 506 of ITE component 106. The contoured outer surface of shell 502 further includes second region 508 that has a second modulus of elasticity and is provided on a lateral end 510 of ITE component 106. A boundary between first region 504 and second region 508 is depicted by a dashed line in FIG. 5. It is understood that the dashed line boundary between first region 504 and second region 508 may extend around an entire circumference of shell 502.

In the example shown in FIG. 5, the first modulus of elasticity of first region 504 may be less than the second modulus of elasticity of second region 508. As such, first region 504 may be relatively more flexible (e.g., softer) than second region 508. With such a configuration, second region 508 is relatively more hard and as such maintains the tactile push-ability of lateral end 510, which facilitates placement of ITE component 106 within the ear canal. Because first region 504 is relatively more flexible, first region 504 facilitates mitigating migration of shell 502 and/or discomfort that may occur due to changes in ear canal shape that may occur during use of ITE component 106.

In the example shown in FIG. 5, the dashed line boundary between first region 504 and second region 508 is provided for illustrative purposes. It is understood that there may or may not be a visible boundary between first region 504 and second region 508 in certain implementations.

Figure 6:
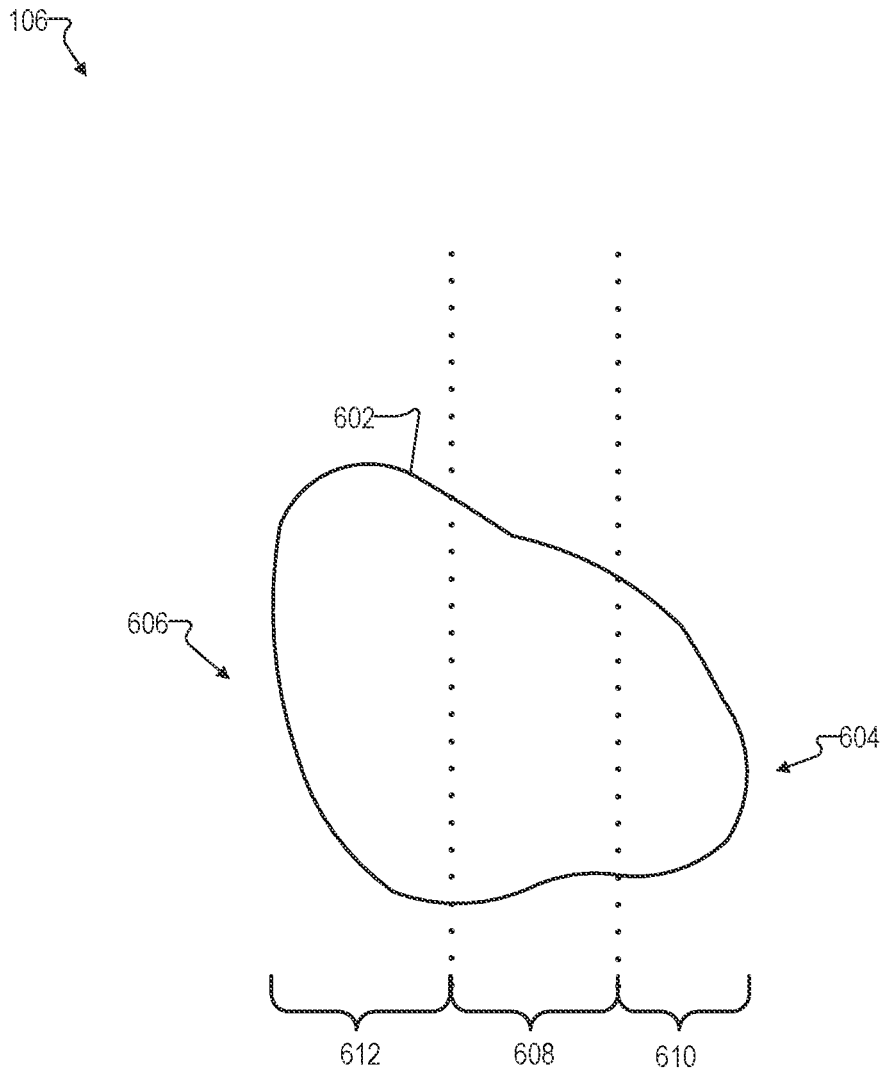

FIG. 6 shows another exemplary configuration of ITE component 106. As shown in FIG. 6, ITE component 106 may include a shell 602 having a medial end 604 and a lateral end 606. Shell 602 includes a first region 608, a second region 610, and a third region 612. The portions of shell 602 that correspond to first region 608, second region 610, and third region 612 are separated by dotted line boundaries that extend vertically in FIG. 6. It is understood that such dotted line boundaries may each extend along an entire outer circumference of shell 702.

As shown in FIG. 6, first region 608 is provided between medial end 604 and lateral end 606 and between second region 610 and third region 612. First region 608 has a first modulus of elasticity and second region 610 has a second modulus of elasticity that is different than the first modulus of elasticity. For example, the first modulus of elasticity may be less than the second modulus of elasticity. In certain examples, third region 612 may have the same modulus of elasticity as second region 610. That is, third region 612 may have the second modulus of elasticity. Alternatively, in certain examples, third region 612 may have a third modulus of elasticity that is different from the first modulus of elasticity and the second modulus of elasticity.

In the example shown in FIG. 6, first region 608, second region 610, and third region 612 may be formed so as to have any suitable modulus of elasticity as may serve a particular implementation. To illustrate an example, the first modulus of elasticity may result in first region 608 having a softness of approximately Shore A 50 whereas the second modulus of elasticity may result in each of second region 610 and third region 612 having a softness of approximately Shore A 90. As such, first region 608 may be relatively more flexible (e.g., more soft) than both second region 610 and third region 612.

In the example shown in FIG. 6, the dotted line boundaries separating first region 608, second region 610, and third region 612 and are provided for illustrative purposes. It is understood that there may or may not be a visible boundary between first region 608 and second region 610 and between first region 608 and third region 612 in certain implementations.

Figures 7A, 7B:
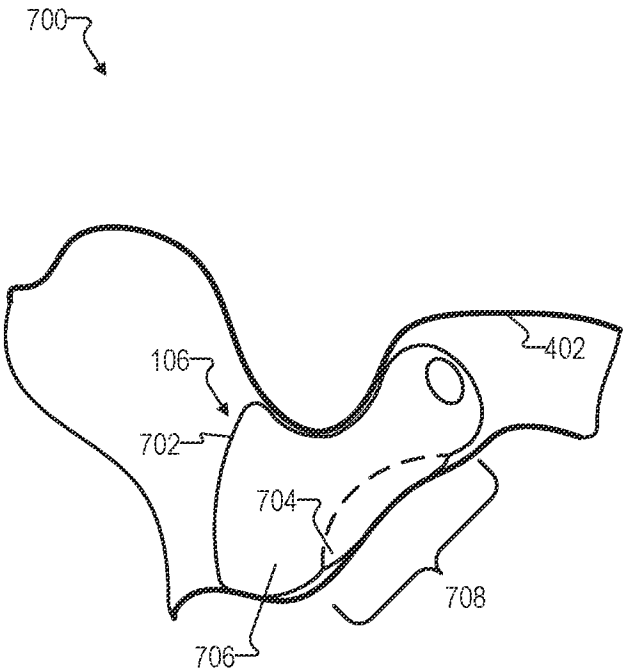

FIGS. 7A and 7B show another exemplary configuration 700 that ITE component 106 may have in certain implementations. As shown in FIG. 7A, ITE component 106 may include a shell 702 that is provided within ear canal 402. Shell 702 may be manufactured in any suitable manner such as described herein. A contoured outer surface of shell 702 includes a first region 704 having a first modulus of elasticity and a second region 706 having a second modulus of elasticity that is different than the first modulus of elasticity. First region 704 and second region 706 are each formed of a same material. In addition, the first modulus of elasticity of first region 704 may be less than the second modulus of elasticity of second region 706. As such, first region 704 may be relatively more soft or flexible than second region 706.

As shown in FIG. 7A, first region 704 protrudes with respect to second region 706. With such a configuration, first region 704 is configured to exert at least a small amount of pressure against ear canal 402 while shell 702 is worn by the user.

As shown in FIG. 7A, first region 704 is positioned so as to align with a region 708 of ear canal 402 that may change shape with jaw movement of the user. Due to the jaw movement of the user, ear canal 402 may change from the state shown in FIG. 7A to the state shown in FIG. 7B. For example, FIG. 7A may depict a state of ear canal 402 in which the mouth of the user is closed. In contrast, FIG. 7B may depict a state of ear canal 402 in which the mouth of the user is open (e.g., due to talking). As shown in FIG. 7B, ear canal 402 is larger in region 708 due to the change in state. As such, an additional space 710 is created between shell 702 and ear canal 402. To illustrate the change, a dashed line 712 in FIG. 7B depicts a previous position of the wall of ear canal 402. Because first region 704 is relatively more flexible than second region 706, first region 704 is configured to expand outward in response to the change in shape shown in FIG. 7B such that shell 702 still contacts a wall of ear canal 402 even when the shape of ear canal 402 changes. With such a configuration, first region 704 of the contoured outer surface of shell 702 is configured to expand and contract as the shape of ear canal 402 changes due to, for example, jaw movement, which improves retention of shell 702 within ear canal 402.

Figure 8:
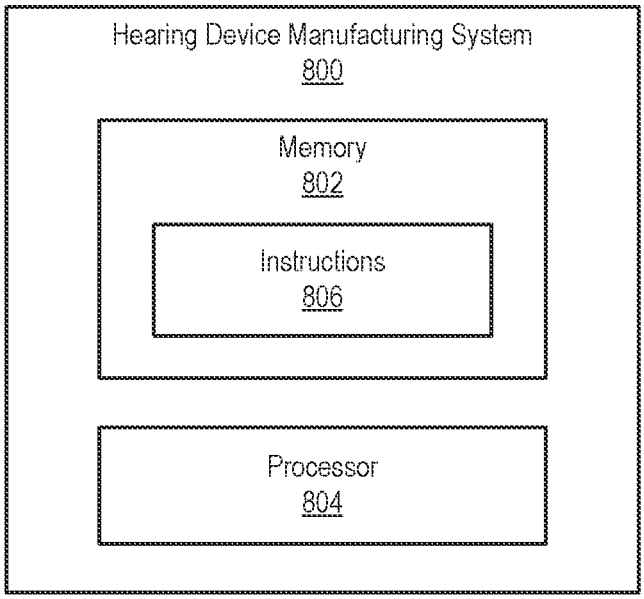
FIG. 8 illustrates an exemplary hearing device manufacturing system that may be used to manufacture the hearing device illustrated in FIG. 1 according to principles described herein.

A shell of ITE component 106 such as any of those described herein may be manufactured using any suitable manufacturing process as may serve a particular implementation. FIG. 8 shows an exemplary hearing device manufacturing system 800 ("system 800") that may be used to manufacture hearing device 100 including the shell of ITE component 106.

As shown in FIG. 8, system 800 may include, without limitation, a memory 802 and a processor 804 selectively and communicatively coupled to one another. Memory 802 and processor 804 may each include or be implemented by hardware and/or software components (e.g., processors, memories, communication interfaces, instructions stored in memory for execution by the processors, etc.). In some examples, memory 802 and processor 804 may be housed within or form part of a single computing device configured to control a manufacturing process of a shell of ITE component 106. In some alternative examples, memory 802 and processor 804 may be distributed between multiple devices and/or multiple locations as may serve a particular implementation.

Memory 802 may maintain (e.g., store) executable data used by processor 804 to perform any of the operations associated with manufacturing a shell of ITE component 106. For example, memory 802 may store instructions 806 that may be executed by processor 804 to perform any of the operations associated with using the same material to form different regions of a shell with different moduli of elasticity. Instructions 806 may be implemented by any suitable application, software, code, and/or other executable data instance.

Memory 802 may also maintain any data received, generated, managed, used, and/or transmitted by processor 804. For example, memory 802 may maintain any suitable data associated with shapes of shells, scans of ear canals of particular users, ear canal shape data, processing parameters used to generate regions of shells with different moduli of elasticity, etc. Memory 802 may maintain additional or alternative data in other implementations.

Processor 804 is configured to perform any suitable processing operation that may be associated with manufacturing ITE component 106 of hearing device 100. Processor 804 may be implemented by any suitable combination of hardware and software.

In certain examples, the shell of ITE component 106 may be custom formed for the user to fit at least partially within an ear canal of a user. In such examples, system 800 may generate or otherwise obtain any information that defines one or more spaces associated with an ear of a user where a customized hearing device may be worn by the user.

In certain examples, system 800 may generate or otherwise obtain a three-dimensional ("3D") scan of an ear of a user. Such a 3D scan may define an available amount of space within an ear canal of the user where ITE component 106 of a customized hearing device may be inserted.

System 800 may obtain a 3D scan in any suitable manner. In certain implementations, system 800 may generate a 3D scan by directly scanning an ear of a user. For example, system 800 may use any suitable 3D scanning device to directly scan the recesses, contours, etc. of an ear of the user to generate a 3D scan. In certain examples, system 800 may use a 3D scanner to directly scan inside an ear canal of the user. In such examples, a 3D scan may provide information indicating an amount of space available within the ear canal for a customized hearing device.

In certain examples, system 800 may obtain multiple 3D scans of an ear canal of a particular user to facilitate manufacturing ITE component 106. For example, system 800 may obtain a first 3D scan of the ear canal while the jaw of the user is in a first state, a second 3D scan of the ear canal while the jaw of the user is in a second state, and a third 3D scan of the ear canal while the jaw of the user is in a third state. The first, second, and third states may correspond to any suitable state of the jaw of the user that may be useful to provide information regarding changes that may occur in the shape of the ear canal as a result of jaw position or movement. For example, the first state may correspond to an open mouth state, the second state may correspond to a clenched jaw state, and the third state may correspond to a closed mouth state. System 800 may compare the first 3D scan, the second 3D scan, and the third 3D scan in any suitable manner to determine where the shape of the ear canal of the user changes as a result of the different states of the jaw of the user. System 800 may then use such information to determine suitable positions of, for example, a first region and a second region on the contoured outer surface of ITE component 106.

In certain alternative implementations, system 800 may generate a 3D scan by scanning an impression made of an ear of a user. For example, during a customized hearing device manufacturing process, an audiologist or the like may insert a shape-forming material (e.g., silicone) into an ear canal of a user. The shape-forming material is configured to retain the shape defining the dimensions of the ear canal when removed from the ear canal. After the impression is removed from the ear canal, system 800 may use any suitable 3D scanner to 3D scan the impression to generate a 3D scan of the ear canal.

In certain examples, multiple impressions may be made of the ear of the user at different states of the jaw of the user such as those described herein. For example, a first impression of the ear canal may be made while the jaw of the user is in a first state, a second impression of the ear canal may be made while the jaw of the user is in a second state, and a third impression of the ear canal may be made while the jaw of the user is in a third state. System 800 may scan the first, second, and third impressions in any suitable manner such as described herein to generate multiple different 3D scans of the ear canal. Similar to that described above, system 800 may compare the 3D scans in any suitable manner to determine suitable positions for the first region and the second region on the contoured outer surface of ITE component 106.

In certain alternative examples, the shell of ITE component 106 may be formed so as to fit any one of a plurality of different users as opposed to being custom formed for a particular user.

System 800 may use any suitable manufacturing process to form the shell of ITE component 106. In certain examples, system 800 may implement a 3D printing process to manufacture a shell of ITE component 106. During such a 3D printing process, system 800 may implement any suitable operation to cause the material used to form the shell to have different moduli of elasticity in different regions. For example, in certain implementations, system 800 may subject the material used to form the shell to varying ultraviolet light exposure to form the different regions of the shell that have different moduli of elasticity. Such ultraviolet light may be applied in any suitable manner. For example, such ultraviolet light may be applied continually during 3D printing, intermittently during 3D printing, or in any other suitable manner. In certain examples, system 800 may perform a customized layer by layer control of ultraviolet exposure during 3D printing to achieve varying material properties within the same print of a particular material.

To illustrate an example, system 800 may use a Digital Light Projector ("DLP") to photopolymerize a photopolymerization resin in a bath by way of ultraviolet cross sections. By varying the intensity of ultraviolet exposure during 3D printing, system 800 may achieve different regions of the same material with different moduli of elasticity. For example, during 3D printing, system 800 may expose a first region of the shell to ultraviolet light having a first intensity. The ultraviolet light at the first intensity may cause the first region of the shell to have a first modulus of elasticity. While 3D printing a second region of the shell, system 800 may expose the second region to ultraviolet light having a second intensity that is different than the first intensity. The ultraviolet light at the second intensity may cause the second region of the shell to have a second modulus of elasticity that is different than the first modulus of elasticity. For example, the second modulus of elasticity may be less than the first modulus of elasticity thereby rendering the second region relatively more soft or flexible than the first region even though the first region and the second region are formed of the same material. In such examples, the relatively softer region(s) of the shell may not be caused by the region(s) of the shell being uncured. Rather, the relatively softer region(s) may be caused by different crosslinking that may occur within the region(s) during ultraviolet exposure.

In certain alternative implementations, system 800 may implement a molding process to manufacture a shell of ITE component 106. Such a molding process may be performed in any suitable manner. For example, the molding process implemented by system 800 may include providing a material into a mold to form a first region of a shell of ITE component 106. After forming the first region, the molding process may include providing the material into the mold to form the second region. In certain examples, the molding process may include subjecting the first region and the second region to varying ultraviolet light exposure in any suitable manner such as described herein. For example, the molding process may include exposing the first region to ultraviolet light having a first intensity and the second region to ultraviolet light having a second intensity that is different than the first intensity to achieve different regions of the same material with different moduli of elasticity.

The preceding disclosure describes various exemplary shells of ITE component 106 that are formed of a same material but that have different regions with different moduli of elasticity. However, it is understood that principles such as those described herein may be used to manufacture other components of hearing device 100 and/or any other suitable device. For example, principles such as those described herein may be used to manufacture a housing of a BTE component such that the housing includes different regions having different moduli of elasticity.

Figure 9:
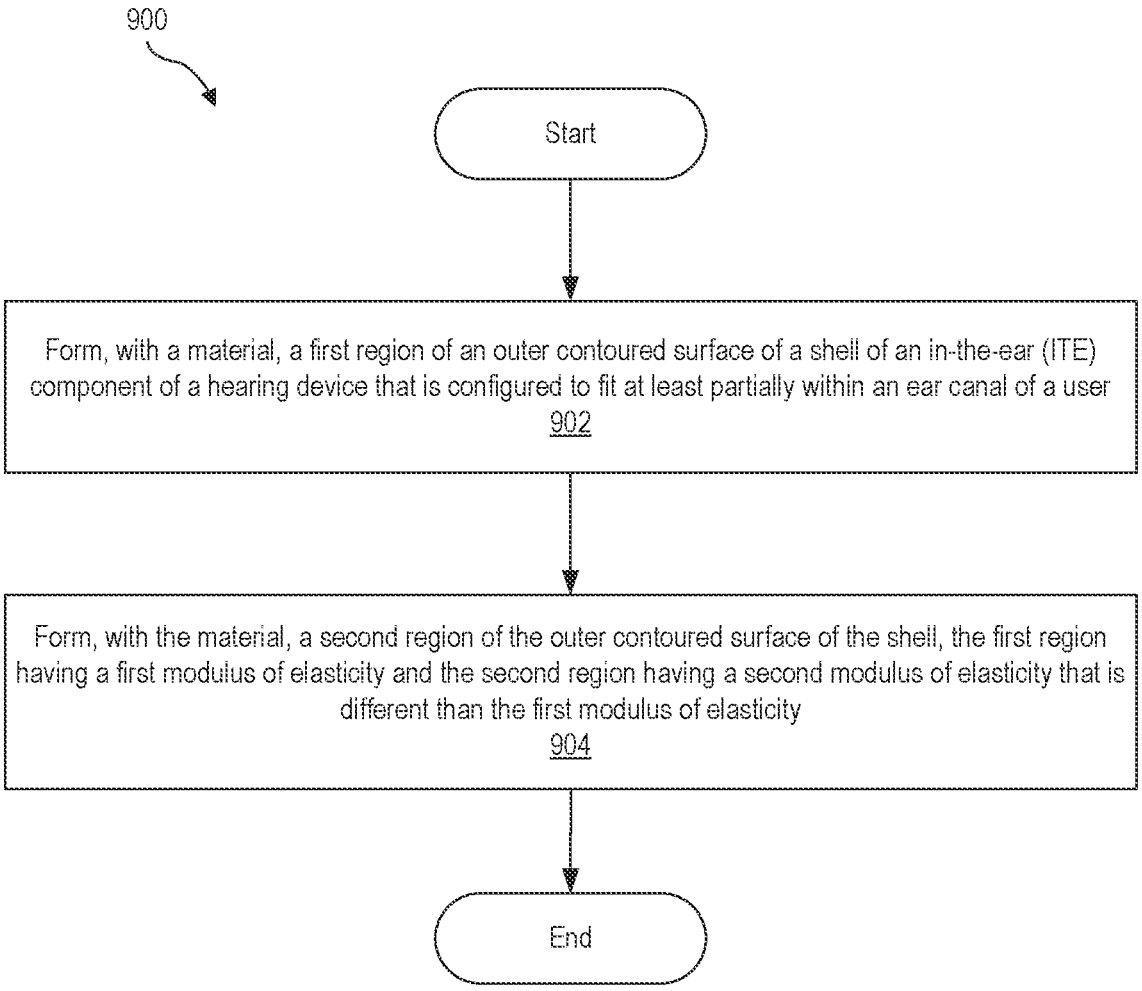
FIG. 9 illustrates an exemplary method according to principles described herein.

FIG. 9 illustrates an exemplary method 900 for manufacturing a hearing device according to principles described herein. While FIG. 9 illustrates exemplary operations according to one embodiment, other embodiments may omit, add to, reorder, and/or modify any of the operations shown in FIG. 9. One or more of the operations shown in FIG. 9 may be performed by a hearing device manufacturing system such as hearing device manufacturing system 800, any components included therein, and/or any implementation thereof.

At operation 902, a material may be used to form a first region of a contoured outer surface of a shell of an ITE component of a hearing device that is configured to fit at least partially within an ear canal of a user. Operation 902 may be performed in any of the ways described herein. For example, a hearing device manufacturing system (e.g., system 800) may instruct a 3D printing device to 3D print the first region of the contoured outer surface of the shell in any suitable manner such as described herein.

At operation 904, the same material may be used to form a second region of the contoured outer surface of the shell. As described herein, the first region may have a first modulus of elasticity and the second region may have a second modulus of elasticity that is different than the first modulus of elasticity. Operation 904 may be performed in any of the ways described herein.

In some examples, a non-transitory computer-readable medium storing computer-readable instructions may be provided in accordance with the principles described herein. The instructions, when executed by a processor of a computing device, may direct the processor and/or computing device to perform one or more operations, including one or more of the operations described herein. Such instructions may be stored and/or transmitted using any of a variety of known computer-readable media.

A non-transitory computer-readable medium as referred to herein may include any non-transitory storage medium that participates in providing data (e.g., instructions) that may be read and/or executed by a computing device (e.g., by a processor of a computing device). For example, a non-transitory computer-readable medium may include, but is not limited to, any combination of non-volatile storage media and/or volatile storage media. Exemplary non-volatile storage media include, but are not limited to, read-only memory, flash memory, a solid-state drive, a magnetic storage device (e.g., a hard disk, a floppy disk, magnetic tape, etc.), ferroelectric random-access memory ("RAM"), and an optical disc (e.g., a compact disc, a digital video disc, a Blu-ray disc, etc.). Exemplary volatile storage media include, but are not limited to, RAM (e.g., dynamic RAM).

Figure 10:
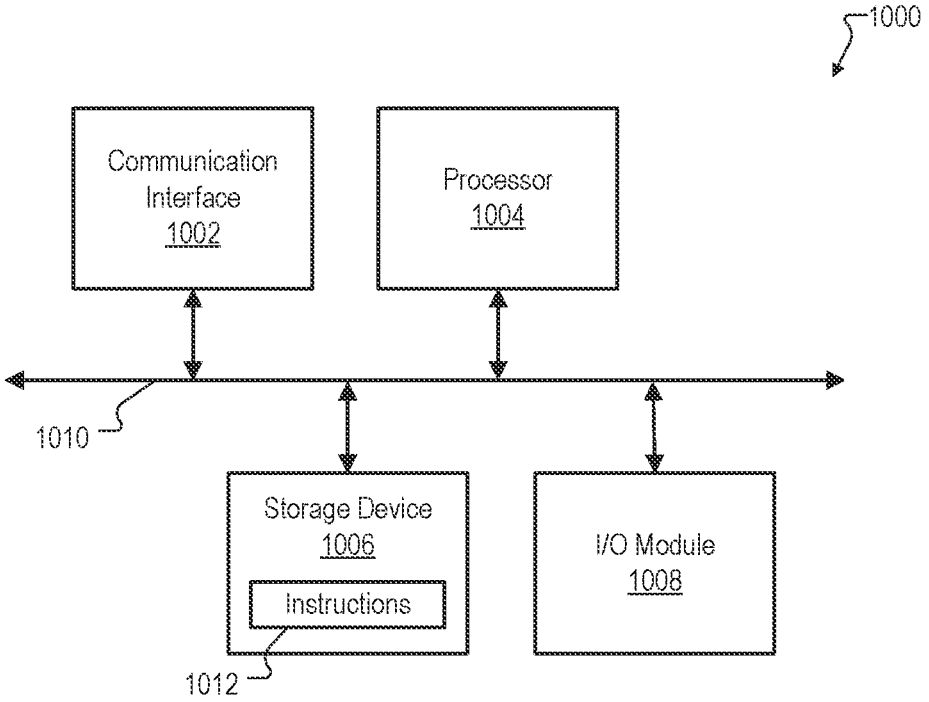
FIG. 10 illustrates an exemplary computing device according to principles described herein.

FIG. 10 illustrates an exemplary computing device 1000 that may be specifically configured to perform one or more of the processes described herein. As shown in FIG. 10, computing device 1000 may include a communication interface 1002, a processor 1004, a storage device 1006, and an input/output ("I/O") module 1008 communicatively connected one to another via a communication infrastructure 1010. While an exemplary computing device 1000 is shown in FIG. 10, the components illustrated in FIG. 10 are not intended to be limiting. Additional or alternative components may be used in other embodiments. Components of computing device 1000 shown in FIG. 10 will now be described in additional detail.

Communication interface 1002 may be configured to communicate with one or more computing devices. Examples of communication interface 1002 include, without limitation, a wired network interface (such as a network interface card), a wireless network interface (such as a wireless network interface card), a modem, an audio/video connection, and any other suitable interface.

Processor 1004 generally represents any type or form of processing unit capable of processing data and/or interpreting, executing, and/or directing execution of one or more of the instructions, processes, and/or operations described herein. Processor 1004 may perform operations by executing computer-executable instructions 1012 (e.g., an application, software, code, and/or other executable data instance) stored in storage device 1006.

Storage device 1006 may include one or more data storage media, devices, or configurations and may employ any type, form, and combination of data storage media and/or device. For example, storage device 1006 may include, but is not limited to, any combination of the non-volatile media and/or volatile media described herein. Electronic data, including data described herein, may be temporarily and/or permanently stored in storage device 1006. For example, data representative of computer-executable instructions 1012 configured to direct processor 1004 to perform any of the operations described herein may be stored within storage device 1006. In some examples, data may be arranged in one or more databases residing within storage device 1006.

I/O module 1008 may include one or more I/O modules configured to receive user input and provide user output. I/O module 1008 may include any hardware, firmware, software, or combination thereof supportive of input and output capabilities. For example, I/O module 1008 may include hardware and/or software for capturing user input, including, but not limited to, a keyboard or keypad, a touchscreen component (e.g., touchscreen display), a receiver (e.g., an RF or infrared receiver), motion sensors, and/or one or more input buttons.

I/O module 1008 may include one or more devices for presenting output to a user, including, but not limited to, a graphics engine, a display (e.g., a display screen), one or more output drivers (e.g., display drivers), one or more audio speakers, and one or more audio drivers. In certain embodiments, I/O module 1008 is configured to provide graphical data to a display for presentation to a user. The graphical data may be representative of one or more graphical user interfaces and/or any other graphical content as may serve a particular implementation.

In some examples, any of the systems, hearing devices, and/or other components described herein may be implemented by computing device 1000. For example, memory 102 or memory 802 may be implemented by storage device 1006, and processor 104 or processor 804 may be implemented by processor 1004.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A hearing device configured to facilitate hearing by a user, the hearing device comprising:

an in-the-ear (ITE) component comprising a shell having a contoured outer surface configured to fit at least partially within an ear canal of the user, wherein:

the contoured outer surface of the shell includes a first region having a first modulus of elasticity and a second region having a second modulus of elasticity that is different than the first modulus of elasticity;

the first region and the second region are formed of a same material; and the shell of the ITE component is formed of a photopolymerization resin that has been subjected to varying ultraviolet light exposure to form the first region and the second region.

2. The hearing device of claim 1, wherein:

the first modulus of elasticity is less than the second modulus of elasticity; and the first region is located on the shell such that, when the ITE component is worn by the user, the first region contacts a portion of the ear canal of the user that changes shape with jaw movement of the user.

3. The hearing device of claim 1, wherein:

the ITE component includes:

a medial end that faces into the ear canal when the ITE component is worn by the user; and a lateral end that faces out of the ear canal when the ITE component is worn by the user;

the contoured outer surface of the shell further includes a third region having the second modulus of elasticity;

the first modulus of elasticity is less than the second modulus of elasticity;

the first region having the first modulus of elasticity is provided between the medial end of the ITE component and the lateral end of the ITE component;

the second region having the second modulus of elasticity is provided on the lateral end of the ITE component; and the third region having the second modulus of elasticity is provided on the medial end of the ITE component.

4. The hearing device of claim 1, wherein the first region of the contoured outer surface of the shell and the second region of the contoured outer surface of the shell each have a same cross-sectional wall thickness.

5. The hearing device of claim 1, wherein:

the first modulus of elasticity is less than the second modulus of elasticity; and the first region includes a protrusion that protrudes with respect to the second region such that the first region exerts pressure against the ear canal while the ITE component is worn by the user.

6. The hearing device of claim 1, wherein the shell of the ITE component is custom formed for the user to fit at least partially within the ear canal of the user.

7. A method comprising:

forming, with a material, a first region of a contoured outer surface of a shell of an in-the-ear (ITE) component of a hearing device that is configured to fit at least partially within an ear canal of a user, the forming of the first region including exposing the first region to ultraviolet (UV) light having a first intensity; and forming, with the material, a second region of the contoured outer surface of the shell, the forming of the second region including exposing the second region to UV light having a second intensity that is different than the first intensity, wherein the first region has a first modulus of elasticity and the second region has a second modulus of elasticity that is different than the first modulus of elasticity.

8. The method of claim 7, wherein:

the forming of the first region further includes three dimensional (3D) printing the first region; and the forming of the second region further includes 3D printing the second region.

9. The method of claim 7, wherein:

the forming of the first region further includes providing the material into a mold; and the forming of the second region further includes providing the material into the mold after the forming of the first region.

10. The method of claim 7, wherein the forming of the first region and the forming of the second region further include forming the first region and the second region such that they each have a same cross-sectional wall thickness.

11. The method of claim 7, wherein:

the first modulus of elasticity is less than the second modulus of elasticity; and the first region is located on the shell such that, when the ITE component is worn by the user, the first region contacts a portion of the ear canal of the user that changes shape with jaw movement of the user.

12. The method of claim 7, wherein the ITE component is custom formed for the user to fit at least partially within the ear canal of the user.

13. The method of claim 7, wherein the material used to form the shell is a photopolymerization resin.

14. A non-transitory computer readable storage medium storing instructions that, when executed, direct a processor of a hearing device manufacturing system to:

form, with a material, a first region of a contoured outer surface of a shell of an in-the-ear (ITE) component of a hearing device that is configured to fit at least partially within an ear canal of a user, the forming of the first region including exposing the first region to ultraviolet (UV) light having a first intensity; and form, with the material, a second region of the contoured outer surface of the shell, the forming of the second region including exposing the second region to UV light having a second intensity that is different than the first intensity, wherein the first region has a first modulus of elasticity and the second region has a second modulus of elasticity that is different than the first modulus of elasticity.

15. The non-transitory computer readable storage medium of claim 14, wherein:

the first modulus of elasticity is less than the second modulus of elasticity; and the first region is located on the shell such that, when the ITE component is worn by the user, the first region contacts a portion of the ear canal of the user that changes shape with jaw movement of the user.

16. The non-transitory computer readable storage medium of claim 14, wherein the material used to form the shell is a photopolymerization resin.

17. The non-transitory computer readable storage medium of claim 14, wherein the forming of the first region and the forming of the second region further include forming the first region and the second region such that they each have a same cross-sectional wall thickness.

* * * * *